United States Patent [19]

Hoet et al.

[11] Patent Number: 4,639,633

[45] Date of Patent: Jan. 27, 1987

[54] ELECTRON TUBE WITH CATHODE COOLING DEVICE

[75] Inventors: Roger Hoet; Pierre Gerlach, both of Thonon les Bains, France

[73] Assignee: Thomson-CSF, Paris, France

[21] Appl. No.: 731,546

[22] Filed: May 7, 1985

[30] Foreign Application Priority Data

May 9, 1984 [FR] France ..... 84 07104

[51] Int. Cl.[4] ..... H01J 7/26

[52] U.S. Cl. ..... 313/35; 313/39

[58] Field of Search ..... 313/35, 32, 39

[56] References Cited

U.S. PATENT DOCUMENTS

| | | | |
|---|---|---|---|
| 2,731,244 | 1/1956 | Manfredi | 313/32 |
| 3,309,556 | 5/1967 | Lien | 313/32 |
| 3,315,107 | 4/1967 | Shrader | 313/35 |
| 3,401,292 | 9/1968 | Cirri | 313/32 |
| 3,882,351 | 5/1975 | Ryabinin et al. | 315/39.51 |

FOREIGN PATENT DOCUMENTS 2517117 5/1983 France .

*Primary Examiner*—Stewart J. Levy
*Assistant Examiner*—Hezron E. Williams
*Attorney, Agent, or Firm*—Roland Plottel

[57] ABSTRACT

An electron tube with a cathode cooling device comprising an anode, a cathode and at least one grid in which the cathode is connected to an output connection through at least one skirt. Inside said tube, at the level of the connection between said skirt and said output connection, a tubular element is provided comprising a spiral shaped part which is extended by at least one inlet tube and one outlet tube emerging on the outside, said tubular element having a cooling fluid flowing therethrough.

2 Claims, 2 Drawing Figures

ELECTRON TUBE WITH CATHODE COOLING DEVICE

BACKGROUND OF THE INVENTION

1. Field of the invention

The present invention relates to an improvement to electron tubes, more particularly power electron tubes operating at frequencies of the order of a few hundred megahertz.

The present invention relates more particularly to a means for internally cooling the structure supporting the cathode of the tube.

2. Description of the prior art

As shown schematically in FIG. 1 which relates to a power tetrode, the electron tubes to which the present invention applies are vacuum tubes formed essentially by cylindrical coaxial electrodes comprising an anode 1, a screen grid 2 called grid $G_2$, a control grid 3 called grid $G_1$ and a cathode 4.

These different electrodes are connected to the outside of the tube through circular metal connections 5, 6, 7, 8 separated from each other by insulators 9, 10, 11, 12 formed preferably from ceramic material and providing in addition sealing of the tube. These metal connections 5, 6, 7, 8 are in general formed by pieces stamped in the shape of cups and are brazed to the insulators.

The metal connections are connected to different voltage sources not shown and serve respectively for the passage of the heating current for the cathode and for the circulation of the high frequency currents.

However, heating of the cathode and circulation of the high frequency currents are heat generators and this heat is removed by conduction towards the metal connections.

Usually, the connections are cooled by injecting compressed air at the head of the tube. In most cases, this cooling is sufficient for maintaining the connections and the brazing of these connections to the insulators at a sufficiently low temperature which does not damage them.

However, the ultra high frequency operation of this type of tube gives rise to a sinusoidal distribution of the electric surface currents. Consequently, some zones of these surfaces which correspond to a current "antinode" where the intensity is maximum, are subjected to intense local heating.

In some cases of operation, these current antinodes are situated at the level of the connections. Consequently, French patent application No. 81 21804 has proposed a cooling system outside the tube formed by a spiral pipe through which flows a cooling fluid and in engagement, preferably by welding, with the connection of the electrode to be cooled.

With this cooling system, a considerable amount of heat is eliminated, in particular in the vicinity of a current "antinode".

However, the heating zones due to current "antinodes" situated inside the tube are not cooled . Now, in some cases, the heating is such that it brings the metal parts up to a high temperature, the resistance to the passage of current increasing the temperature. Thus, the increase in temperature may be such that the vapor tensions of the metals from which the electrodes are formed are reached. In this case, there is an emission of gas which results in at least a local deterioration of the vacuum and renders the tube unserviceable.

Furthermore, in power electron tubes of known type, the cylindrical shaped cathode comprises a sleeve formed by a network of crossed wires made preferably from thorium coated tungsten. This cylindrical sleeve is connected to the output connection through at least a skirt made from a refractory material such as tantalum, molybdenum or similar. Now, there also exist current "antinodes" on said skirt, which "antinodes" furnish heat which is added to that coming from the cathode. This heat is very difficult to remove outside the tube, for the connections are generally made from an iron-nickel-cobalt alloy which is a very poor heat conductor and of a small thickness so as to be readily brazed to the contiguous ceramic insulators.

Depending on the position of the current "antinodes" excessive heating of one end of the cathode may occur, which may cause localized deformations of said cathode which are harmful to the useful life of the tube.

SUMMARY OF THE INVENTION

The aim of the present invention is to overcome the above disadvantages by cooling the parts where the current "antinodes" occur, while involving no reduction in the operating temperature of the cathode or an appreciable increase in its heating power.

The present invention provides an electron tube with coaxial electrodes formed by an anode, a cathode and at least one grid in which the cathode is connected to an output connection through at least a skirt, and further comprising, inside the tube at the level of the connection between the skirt and the output connection, a tubular element having a spiral shaped part which is extended by inlet and outlet tubes emerging outside the electron tube, said tubular element having a cooling fluid flowing therethrough.

In a preferred embodiment, the spiral shaped tubular element is made from a metal such as nickel or copper. Preferably, it is brazed in a groove formed in the plate supporting the skirt of the cathode.

Furthermore, with the plate formed preferably from molybdenum or nickel and the connections being preferably formed from an iron-nickel-cobalt alloy, these different parts have different expansion coefficients. Consequently, in order to accomodate the stresses on the cooling element between the plate and the connection, the cooling element has a U bend which gives it resilience.

BRIEF DESCRIPTION OF THE DRAWINGS

Other features and advantages of the present invention will appear from reading the description of one embodiment made with reference to the accompanying drawings in which.

In the Figures, the same references designate the same elements.

DESCRIPTION OF THE PREFERRED EMBODIMENT

Figure 1:
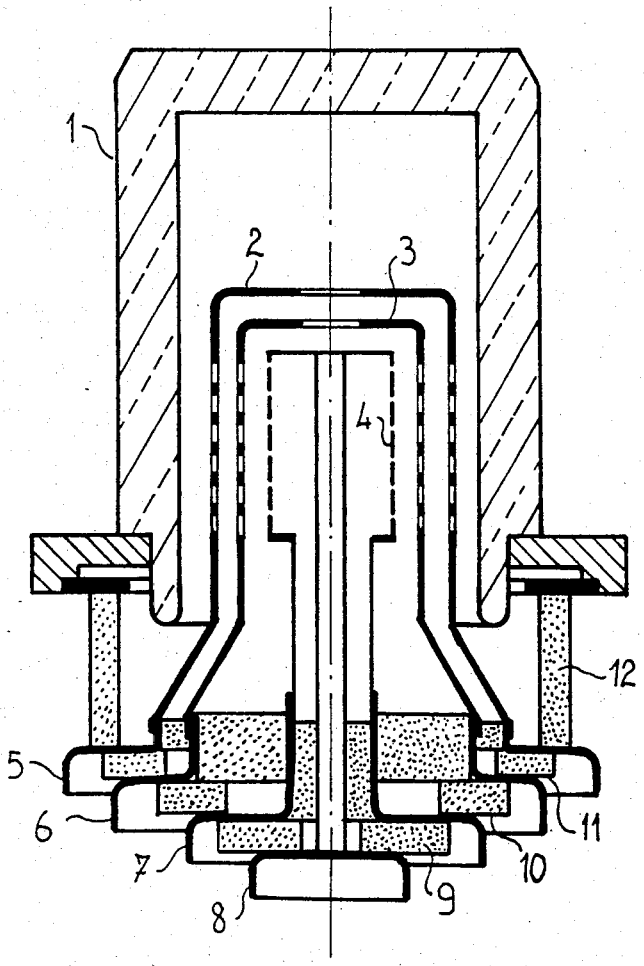
FIG 1 PRIOR ART
FIG. 1, already described, is a schematical section of an electronic tube to which the invention applies.
Figure 2:
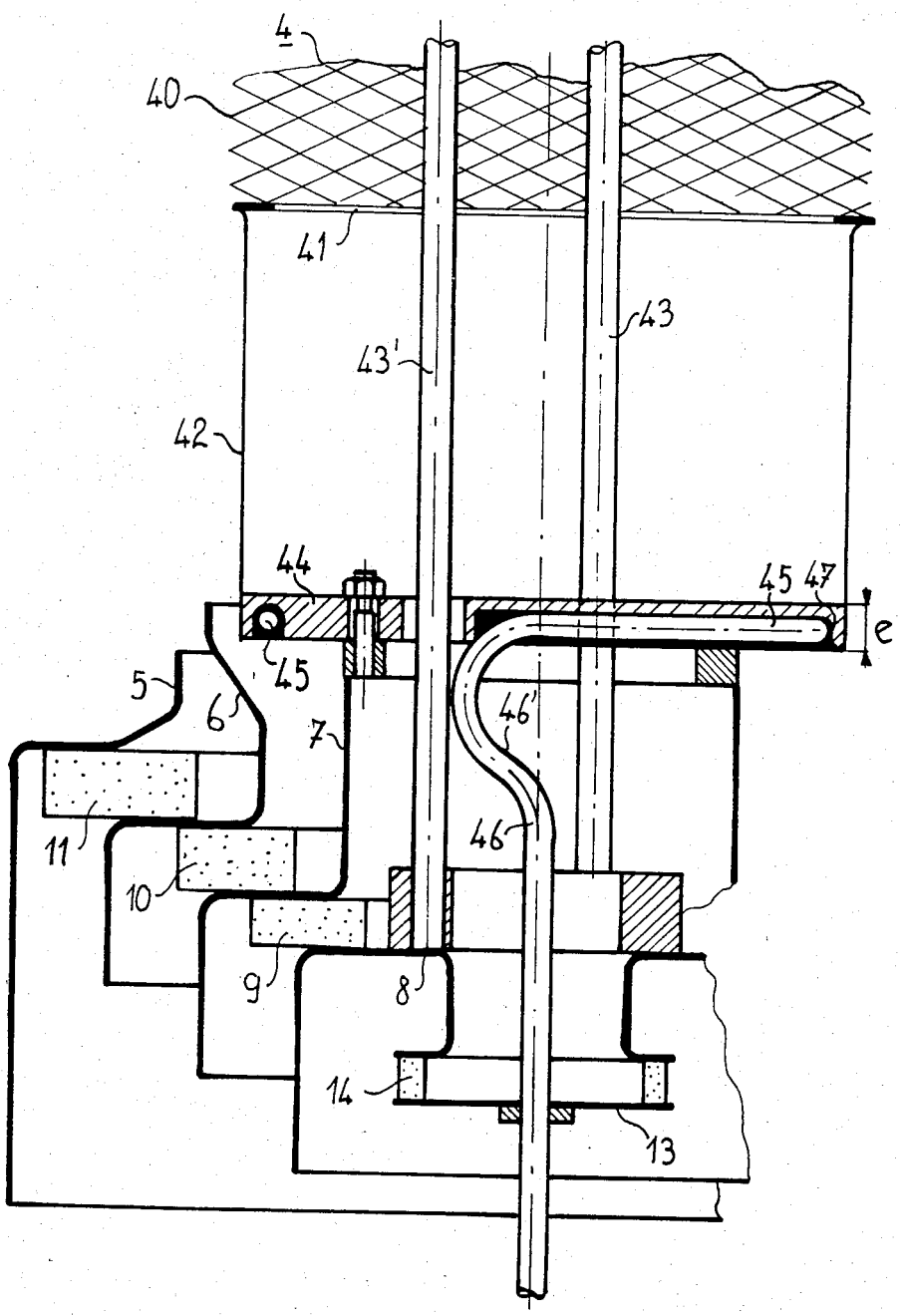
FIG. 2 is an enlarged sectional view of the cathode of the tube of FIG. 1 comprising a cooling means in accordance with the present invention.

In the embodiment shown in FIG. 2, cathode 4 comprises a cylindrical sleeve 40 formed in a way known per se by a network of crossed wires made for example from tungsten which may be coated with thorium or not. The two ends of the sleeve are fixed respectively to two metal plates, only the lower plate 41 having been shown.

The lower plate is connected to the output connection 7 by means of a cylindrical skirt 42 made from a refractory metal material such as tantalum, molybdenum or similar. In fact, the skirt is welded to an intermediate plate 44 on which said connection is fixed. Furthermore, the upper plate is connected by rods 43, 43' to connection 8. The potential difference applied between connections 7 and 8 ensures that the cathode is brought up to and kept at its working temperature.

In accordance with the present invention, a fluid flow cooling means is provided at the level of the connection between skirt 42 and connection 7. More specifically, the cooling means is formed by a tubular element having a spiral shaped part 45 which is extended by tubes for the inlet 46 and outlet (not shown) of the cooling liquid, said tubes emerging outside the vacuum tube as shown in FIG. 2.

The spiral shaped part 45 of the tubular element is brazed by copper brazing in a groove 47 formed in plate 44 supporting the metal skirt 42. More specifically, the intermediate plate has a certain thickness e. It is made preferably from nickel or molybdenum and the connection 7 preferably formed from an iron-nickel-cobalt alloy is bolted to said plate.

Furthermore, the tubular element is made from nickel or copper. In addition, the inlet 46 and outlet tubes have the U shaped bend 46' for accomodating the stresses due to the difference in expansion between connection 7 and plate 44.

For passing the inlet and outlet tubes, connection 8 is cut at its central part so as to have an annular shape as shown in FIG. 2. A plate 13 having a passage for the inlet and outlet tubes closes the head of the tube. This plate 13 is brazed to an insulator 14 separating it from connection 7.

With the above described cooling means, the current "antinodes" are cooled on the refractory skirt. Furthermore, since the cooling means is spaced relatively far apart from the cathode properly speaking, there is no reduction in the operating temperature and there is no need to increase the heating power for maintaining the required operating level. Thus, with this cooling device, power increases up to three times as great may be obtained for a given frequency.

In addition, the intermediate plate 44 supporting the refractory skirt 42 is cooled. It thus serves as a screen for the heat coming from the cathode and protects the base where the ceramic insulators are brazed.

It is obvious for a man skilled in the art that the present invention may be used in all power electron tubes such as triodes, tetrodes, or pentodes requiring considerable cooling.

We claim:

1. An electron tube comprising coaxial electrodes including a cathode, an anode and at least a control grid, means forming with said electrodes a tube envelope, skirt means within said envelope having a first end and a second end, said first end connected to the cathode, plate means within said envelope and connected to said second end of said skirt means, output connection means connected to the plate means and extending through the envelope for providing external connection to the cathode, and tubular means having a spiral portion with an inlet and an outlet and included within said plate means for flowing cooling fluid for cooling said plate means and said skirt means with little cooling of the cathode.

2. An electron tube in accordance with claim 1 in which the plate means includes a groove for supporting the spiral portion of the tubular means.

* * * * *